US007559674B2

(12) United States Patent
He et al.

(10) Patent No.: US 7,559,674 B2
(45) Date of Patent: Jul. 14, 2009

(54) MOUNTING ARRANGEMENT FOR LED LAMPS

(75) Inventors: Xi Yuan He, Guangzhou (CN); Rui Ma, Guangzhou (CN); Giovanni Scilla, Fontane di Villorba (IT)

(73) Assignee: Osram Gesellschaft mit beschraenkter Haftung, Munich (DE)

( * ) Notice: Subject to any disclaimer, the term of this patent is extended or adjusted under 35 U.S.C. 154(b) by 31 days.

(21) Appl. No.: 11/806,135

(22) Filed: May 30, 2007

(65) Prior Publication Data

US 2007/0279906 A1 Dec. 6, 2007

(30) Foreign Application Priority Data

May 31, 2006 (EP) ..... 06425372

(51) Int. Cl.
*F21V 21/00* (2006.01)

(52) U.S. Cl. ..... 362/249.02; 362/362; 362/365; 362/377; 362/800; 315/57; 315/276; 315/291; 315/169.1

(58) Field of Classification Search ..... 362/249, 362/362, 364, 365, 368, 372, 377, 378, 800, 362/249.02; 315/56–58, 71, 274, 291, 276, 315/169.1, 169.3, 209 R; 439/230, 271, 439/280; 363/146
See application file for complete search history.

(56) References Cited

U.S. PATENT DOCUMENTS

| | | | | |
|---|---|---|---|---|
| 4,727,289 | A * | 2/1988 | Uchida | 315/71 |
| 5,463,280 | A * | 10/1995 | Johnson | 315/187 |
| 5,696,477 | A * | 12/1997 | Yamamori et al. | 336/192 |
| 5,767,630 | A * | 6/1998 | Williams | 315/282 |
| 6,388,396 | B1 * | 5/2002 | Katyl et al. | 315/294 |
| 6,787,999 | B2 | 9/2004 | Stimac et al. | |
| 6,797,999 | B2 | 9/2004 | Hou et al. | |
| 7,111,961 | B2 * | 9/2006 | Trenchard et al. | 362/235 |
| 7,259,975 | B2 * | 8/2007 | Holme Pedersen et al. | 363/146 |
| 2005/0024864 | A1 | 2/2005 | Galli | |
| 2005/0110649 | A1 | 5/2005 | Fredericks et al. | |
| 2007/0290625 | A1 * | 12/2007 | He et al. | 315/274 |
| 2008/0130298 | A1 * | 6/2008 | Negley et al. | 362/365 |

FOREIGN PATENT DOCUMENTS

WO 02/066889 8/2002

* cited by examiner

*Primary Examiner*—Haissa Philogene

(57) ABSTRACT

A LED lighting arrangement includes a support body having mounted thereon one or more LED lighting sources and a driver or feeding the LED lighting sources. The support body includes a high-voltage section carrying the driver and a low-voltage section carrying, mounted on a heat sink, the light sources. An insulation barrier is provided between the high voltage section and the low-voltage section of the board with a twisted pair forming a wiring that traverses the insulation barrier to connect the driver and the LED lighting sources.

4 Claims, 1 Drawing Sheet

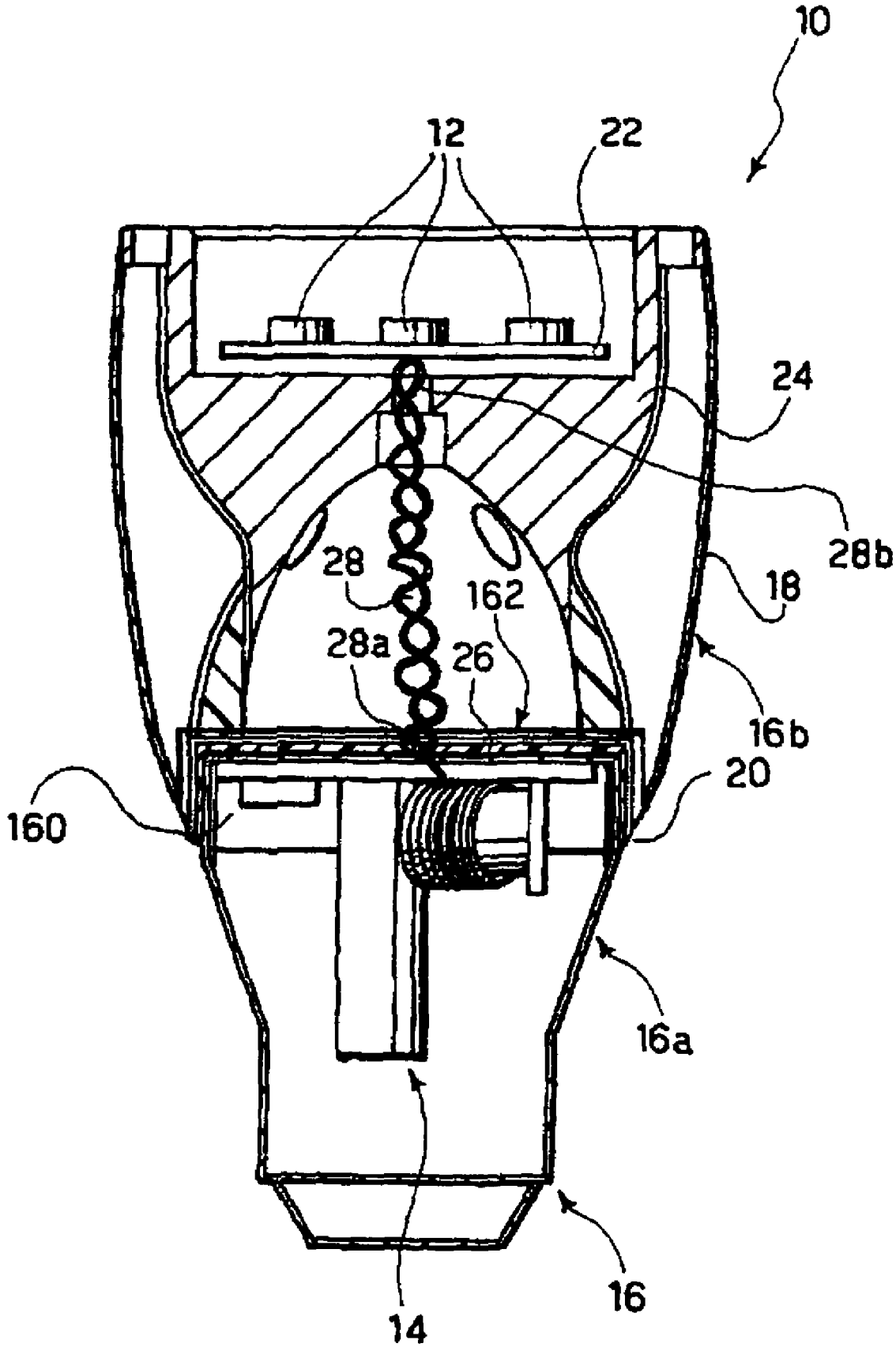
10
12
22
24
28b
18
28
162
28a
26
16b
20
160
16a
16
14

MOUNTING ARRANGEMENT FOR LED LAMPS

FIELD OF THE INVENTION

The invention relates to LED lamps and, more specifically, to mounting arrangements for such lamps.

DESCRIPTION OF THE RELATED ART

Light emitting diodes (or LEDs) are meeting with an increasing success in their use as lighting sources, i.e. as lamps. This applies particularly to so-called high-flux (HF) LEDs. A significant advantage of LED lamps lies i.a. in the possibility of grouping together several LED sources having different emission wavelengths characteristics with the ensuing possibility of selectively varying the chromatic characteristics of the resulting lighting radiation thus produced.

Proper heat sinking of such LED-based lighting sources is a key requirement to preserve the operating life time of the LEDs for a long time. Direct coupling of high-flux LEDs onto a metal heat sink and accessible (that is, unshielded) heat sink operation in open air for thermal dissipation by convection are strongly preferred. Accessible heat sink operation means that the heat sink and the LED side, that is the secondary side of the transformer feeding the LED source(s), are accessible so that they can be safely touched by a user during operation. The heat sink and the LED side of the LED lamp must thus be properly insulated by satisfying the requirements in terms of creepage/clearance distances, insulation resistance and dielectric strength dictated by safety standards such as SELV-rated insulation, SELV being an acronym for Safety Extra Low Voltage.

The need is therefore felt for a properly insulated (e.g. SELV-rated) system for LED lamps, this being particularly the case for self-ballasted high-flux LED lamps supplied from an AC line, such as the common household mains voltage.

OBJECT AND THE SUMMARY OF THE INVENTION

The object of the invention is to provide a fully satisfactory response to that need.

The arrangement described herein is adapted to provide a self-rated insulation system for a self-ballasted high-flux LED lamp supplied from an AC line by providing a number of significant advantages. These include, i.e.:

- an easier and more reliable compliance with SELV requirements,
- smaller dimensions of the printed circuit board (PCB) onto which the lamp driver is mounted, and
- a reduced number of wire connections to the light source from the high-voltage section of the driver circuitry.

BRIEF DESCRIPTION OF THE ANNEXED REPRESENTATIONS

The invention will now be described, by way of example only, by referring to the enclosed FIGURE of drawing, which represents a general sectional view of a mounting arrangement as described herein.

DETAILED DESCRIPTION OF A PREFERRED EMBODIMENT OF THE INVENTION

In the annexed FIGURE of drawing, reference 10 designates as a whole a lighting source (i.e. a "lamp") including at least one light emitting diode (LED), and, preferably, a plurality of LEDs 12 as the generating source of the lighting radiation. Typically, the LEDS 12 are of the high-flux (HF) type and are fed via an electronic driver 14.

The lamp 10 essentially includes a support body 16 onto which the LED sources 12, the driver 14 and a number of components associated therewith are mounted as better detailed in the following.

These components are at least partly enclosed within a casing 18. In a preferred embodiment as described herein the casing has a shape somewhat reminiscent of the shape of a conventional light bulb with the LED sources 12 at its distal end and the driver 14 at its proximal end, respectively.

As clearly visible in the drawing, the body 16 is partitioned into two sections, namely a high-voltage (HV) section 16*a* and a low-voltage (SELV) section 16*b*. The two sections 16*a*, 16*b* may be separated by a gap 20 extending along a non-rectilinear path. Typically, one of the two sections 16*a*, 16*b*, preferably the section 16*a*, includes a protruding portion 160 extending into a corresponding recess 162 in the other section 16*b* to produce a mating relationship between the two board sections 16*a*, 16*b*.

Typically, the LED sources 12 are carried by a board 22 and are directly mounted on a heat conductive metal (e.g. aluminium, light-alloy) heat sink 24. The heat sink 24 has a hollow domed-shaped section 24*a* opening towards the driver 14 with the interposition of insulating (e.g. plastics) layer forming a barrier or shield 26. The layer 26 is typically in the form of a cap mounted (e.g. by snap-fit engagement) onto the protrusion 160 of the high-voltage section 16*a* of the body 16 in order to at least partly surround the transformer 14 carried thereby.

Finally, reference 28 indicates a twisted wire pair connecting the secondary winding of the transformer of driver 14 to the LED sources 12. The wiring 28 extends through corresponding holes 28*a* and 28*b* provided in the barrier 26 and in the heat sink 24, respectively. Using a twisted pair for the wiring 28 provides an improved radio frequency interference (RFI) behaviour and is also advantageous because only two wire solderjoints, in the place of four, must be soldered to achieve the proper connection.

In a preferred embodiment of the arrangement described herein, the driver 14 includes a fly-back transformer whose secondary winding is comprised of a triple-insulation wire. Preferably, the secondary winding of the transformer is not soldered in correspondence with the transformer bobbin: a so-called "floating" connection is thus preferred in order to minimize (and notionally dispense with) creepage/clearance requirements. Typically, the transformer is an insulation transformer that keeps 6 mm creepage/clearance and 4 kV insulation between the high-voltage and the low-voltage sections of the circuit (in the case of 230 V ac line voltage).

The LED lamp arrangement described herein is thus partitioned into sections:

- a high-voltage section, identified by the body section 16*a*, that includes the driver 14 as well as the associated circuitry (of a known type) for providing input rectification and dc-dc conversion via e.g. a fly-back converter arrangement, and
- a low-voltage section, identified by the body section 16*b*, that includes the LED sources 12 directly coupled (i.e. mounted) to the heat sink 24 as well as the associated circuitry (again of a known type) for providing secondary rectification and the wiring to the light source board 22.

The high-voltage section 16*a* and the low-voltage section 16*b* referred to in the foregoing are separated by an insulation barrier. This is essentially provided by the insulation transformer 14 and the plastic barrier 26 mounted thereon.

The barrier 26 is preferably comprised of plastic body essentially in the form of a cap adapted to achieve mechanical connection of the two sections of the arrangement while ensuring (possibly together with the gap 20, if present) the desired degree of separation. The size of the hole 28*a* through the cap 26 can be kept to a minimum value for the wiring 28 to pass therethrough.

The arrangement described herein achieves an optimal coupling of the light source body section 16*b* towards the heat sink 24 which is conductive and must be accessible (i.e. freely touchable) during operation. Consequently, this section of the "lamp" plus the heat sink 24 are properly insulated, e.g. SELV-rated. The arrangement disclosed is intended to be supplied directly from the mains voltage whereby the SELV requirements (creepage/clearance distances, insulation resistance, dielectric strength) are very strong. The arrangement described herein meets these requirements without any appreciable negative impact on miniaturization, costs of materials and assembly, reliability in large-scale production.

Of course, without prejudice to the underlying principles of the invention, the details and embodiments may vary, even significantly, with respect to what has been described and shown just by way of example, without departing from the scope of the invention as defined by the annexed claims.

The invention claimed is:

1. A mounting arrangement for an LED lamp comprising:

a support body having mounted thereon at least one LED light source and a driver for feeding said at least one LED lighting source;

said support body having a high-voltage section carrying said driver and a low-voltage section carrying said at least one LED lighting source;

said low-voltage section including an electrically conductive heat sink on which said at least one LED light source is mounted, said heat sink being freely touchable during operation of said LED lamp;

an insulation barrier being provided between said high-voltage section and said low-voltage section of said body with a wiring traversing said insulation baffler to connect said driver and said at least one LED lighting source;

said high-voltage section having a protrusion that extends into a corresponding recess in said low-voltage section to produce a mating relationship between said sections; and said insulation barrier being in the form of a cap that is mounted onto said protrusion and adapted to achieve a mechanical connection of said sections of said arrangement.

2. The arrangement of claim 1, wherein said driver includes a fly-back transformer with a floating secondary winding.

3. The arrangement of claim 1, wherein said wiring is in the form of a twisted pair.

4. The arrangement of claim 2, wherein said wiring connects said secondary winding to said at least one LED lighting source.

* * * * *